US006566972B2

(12) United States Patent
Paquette et al.

(10) Patent No.: US 6,566,972 B2
(45) Date of Patent: May 20, 2003

(54) FERRITE-CIRCUIT ALIGNING FRAME

(75) Inventors: Stanley V. Paquette, Dracut, MA (US); Thomas T. Lee, Chelmsford, MA (US); Randal W. Chalifour, Peabody, MA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/881,470

(22) Filed: Jun. 14, 2001

(65) Prior Publication Data

US 2002/0190808 A1 Dec. 19, 2002

(51) Int. Cl.[7] ..... H01P 1/387
(52) U.S. Cl. ..... 333/1.1; 333/24.2
(58) Field of Search ..... 333/1.1, 24.2; H01P 1/36, 1/383, 1/387

(56) References Cited

U.S. PATENT DOCUMENTS 6,011,449 A * 1/2000 Jussaume et al. ..... 333/1.1
2001/0040484 A1 * 11/2001 Kim ..... 333/24.2

FOREIGN PATENT DOCUMENTS

FR 2246114 A * 4/1975 ..... H03H/07/48
JP 11168304 A * 6/1999 ..... H01P/01/383

* cited by examiner

*Primary Examiner*—Justin P. Bettendorf

(57) ABSTRACT

An alignment frame for a passive radio frequency ferrite isolator or circulator aligns ferrite discs with the circuit and the housing in which these components are encased. The fragile leads of the circuit are supported by the alignment frame, thereby creating a more durable and robust package design for handling and customer product interfacing. No adhesive is used, thereby reducing manufacturing time and increasing reliability of the device.

19 Claims, 11 Drawing Sheets

FERRITE-CIRCUIT ALIGNING FRAME

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

Ferrite isolators and circulators are passive devices that allow transmission of radio frequency energy in one direction, but prevent or isolate transmission in the opposite direction. Such devices are located, for example, at the output of components such as power amplifiers to protect them from damage from reverse power transmission such as from a loss of a downstream component. Thus, for example, reverse flow into the isolator may be safely dissipated as heat rather than flow back into the upstream component.

In assembly of a typical ferrite isolator or circulator, illustrated in FIGS. 1–4, two ferrite discs 10, 12 are aligned above and below a center conductor or circuit 14 within an enclosing housing 16. In assembly, referring to FIG. 1, the ferrite discs and the circuit are secured with an adhesive 18 into a sandwich structure 20 and aligned in a mechanical fixturing device 22 that clamps the circuit/ferrite sandwiches together to minimize the gap between the circuit and the ferrite discs. The fixturing device, which can hold several sandwiches, is placed in an oven for curing. After curing, the circuit/ferrite sandwiches and any further necessary components (illustrated in FIG. 3) are placed in the housing 16 and aligned in an alignment fixture 24 (FIG. 4). The complete assembly is secured with a snap-on cover 26 that has a built in spring force.

The handling and manipulating of the required fixtures and the application of adhesive, however, is not an efficient method of manufacturing such a device. Also, the adhesive necessarily introduces a gap between the ferrite discs and the circuit that may negatively impact the electrical performance of the device throughout the effective useful temperature range. Further, because the leads of the circuit are typically made of thin, soft copper and protrude without protection from the housing, the leads are susceptible to damage. Additionally, once removed from the fixture, the circuit/ferrite assembly is held in the housing by friction and the spring force of the cover. Any excessive force on the circuit/ferrite assembly could overcome this retention force and shift the circuit/ferrite assembly. Mechanical stresses on the circuit and/or the ferrite discs may also overcome the sheer strength of the adhesive and thereby disable the device.

A support frame 28 for triangular ferrite discs 30 is known, illustrated in FIG. 5. This frame, however, does not protect the fragile circuit leads from external forces.

SUMMARY OF THE INVENTION

In the present invention, an alignment frame is provided that aligns the ferrite discs with the circuit and the housing in which these components are encased. Direct or indirect external forces on the circuit and/or the ferrite discs are directed to the alignment frame. No adhesive is used, thereby reducing manufacturing time and increasing reliability of the device. Additionally, the fragile leads of the circuit may be integrated or directly supported by the alignment frame, thereby creating a more durable and robust package design for handling and customer product interfacing.

More particularly, the alignment frame comprises a nonconductive peripheral member having an exterior upstanding wall comprising wall portions separated by spaces disposed to receive the leads of the circuit. Bridging pieces join the wall portions and extend across the spaces to support associated ones of the leads of the circuit. Nonconductive leg members extend radially outwardly from each bridging piece to support the fragile circuit leads. In one embodiment, a conductive member is disposed proximate the tip of each leg member for electrical connection with an associated circuit lead. The conductive member may be a pin in a through-hole or a wrap-around tab member. Alternatively, the leads of the circuit may themselves be wrapped around the conductive legs.

The alignment frame may also include interior upstanding wall portions in spaced alignment with the exterior wall portions to provide flexibility to accommodate ferrite discs having larger dimensional tolerances. The interior wall portions may be split at a midpoint to provide further flexibility. The bridging pieces may include projections to space the circuit away from the alignment frame. The wall portions may also include projections disposed to contact and retain notched edges of associated ones of the leads of the circuit.

DESCRIPTION OF THE DRAWINGS

The invention will be more fully understood from the following detailed description taken in conjunction with the accompanying drawings in which.

DETAILED DESCRIPTION OF THE INVENTION

Figure 1:
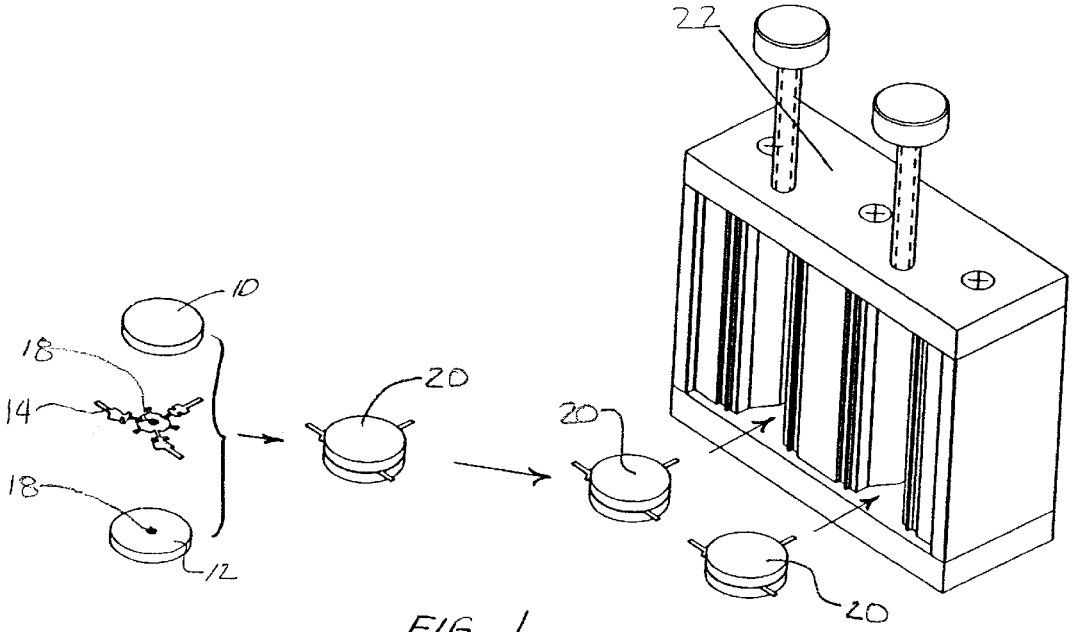
FIG. 1 PRIOR ART
FIG. 1 is an isometric view of steps in manufacturing a prior art ferrite circulator.
Figure 2:
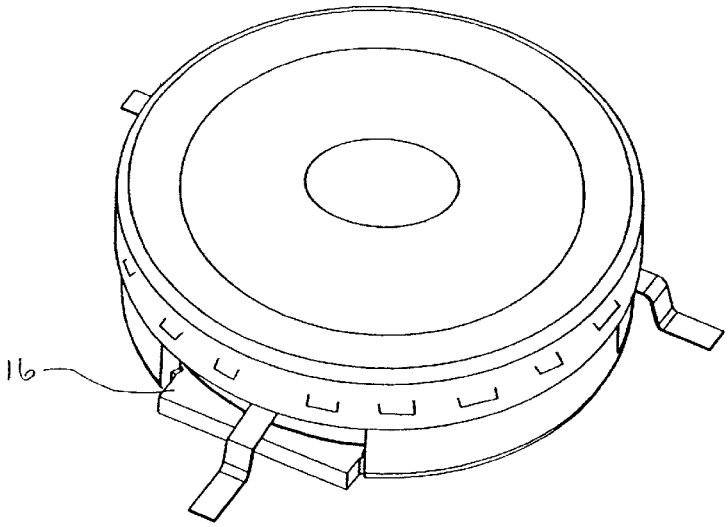
FIG. 2 PRIOR ART
FIG. 2 is an isometric view of a prior art ferrite circulator.
Figure 3:
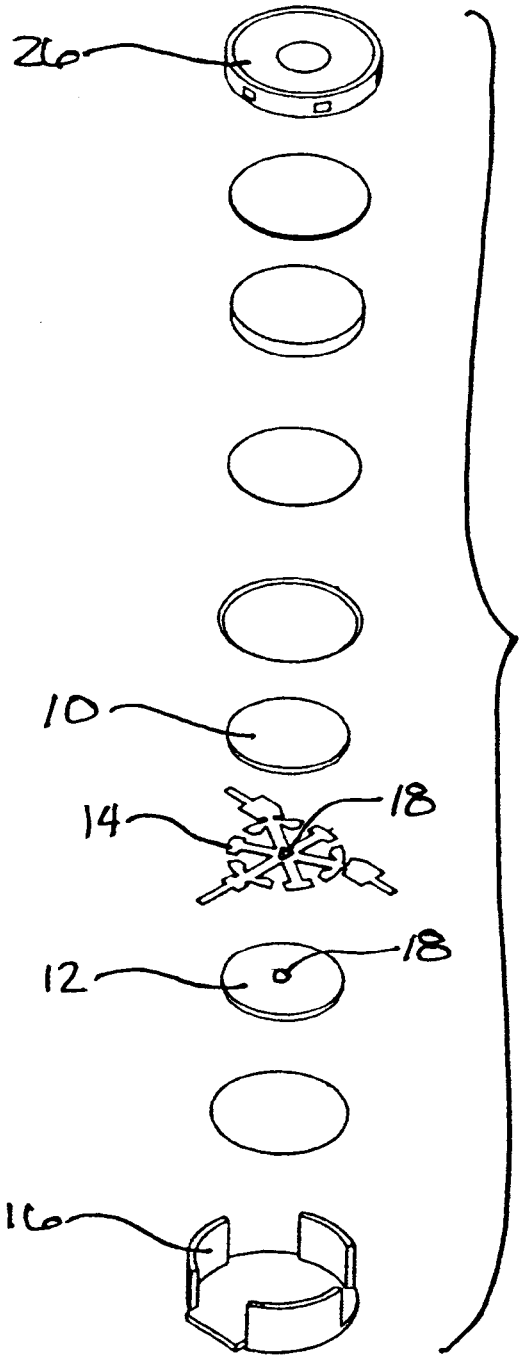
FIG. 3 PRIOR ART
FIG. 3 is an exploded isometric view of a prior art ferrite circulator.
Figure 4:
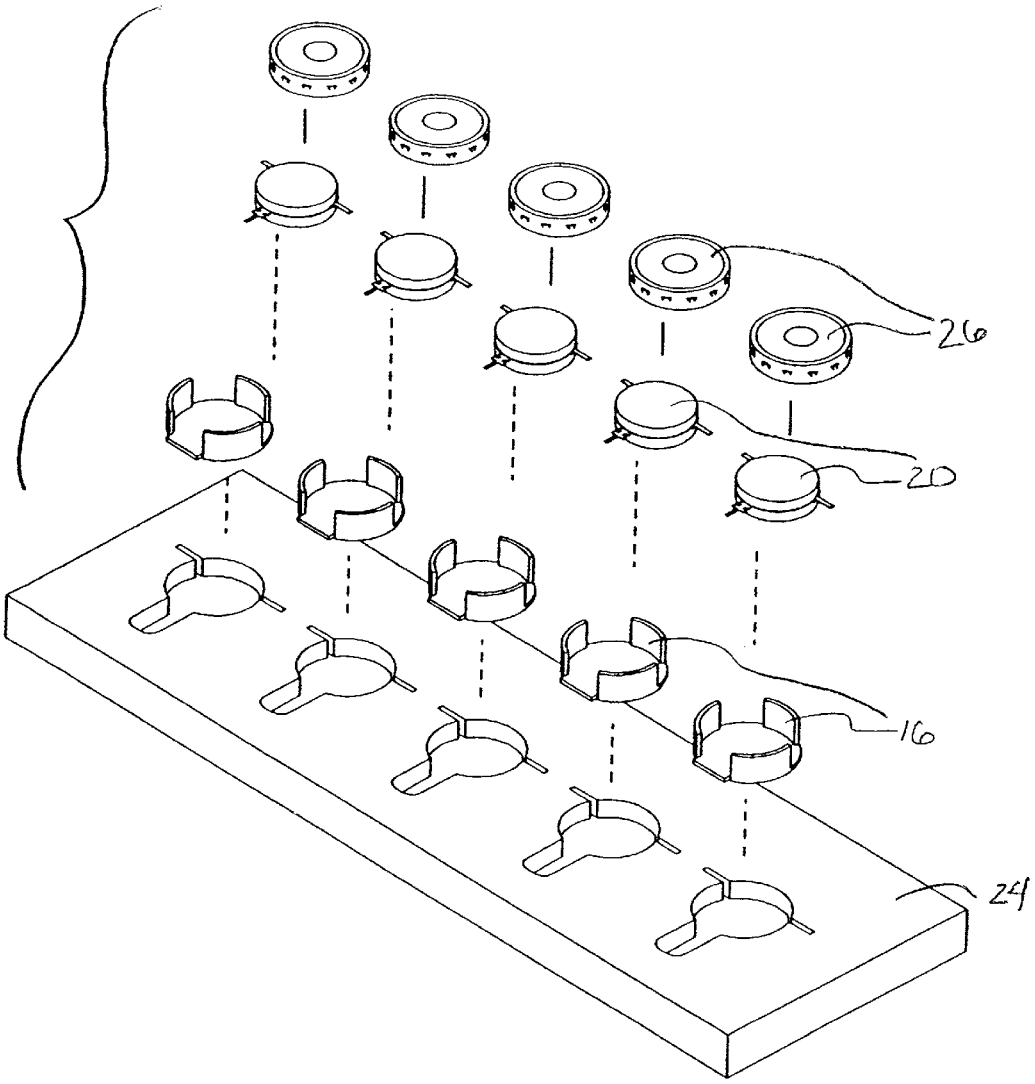
FIG. 4 PRIOR ART
FIG. 4 is an isometric view of further steps in manufacturing a prior art ferrite circulator.
Figure 5:
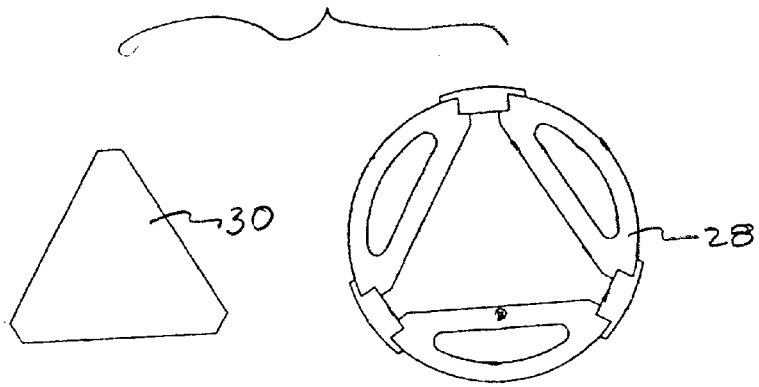
FIG. 5 PRIOR ART
FIG. 5 is an exploded view of a prior art triangular ferrite disc and support frame.
Figure 6:
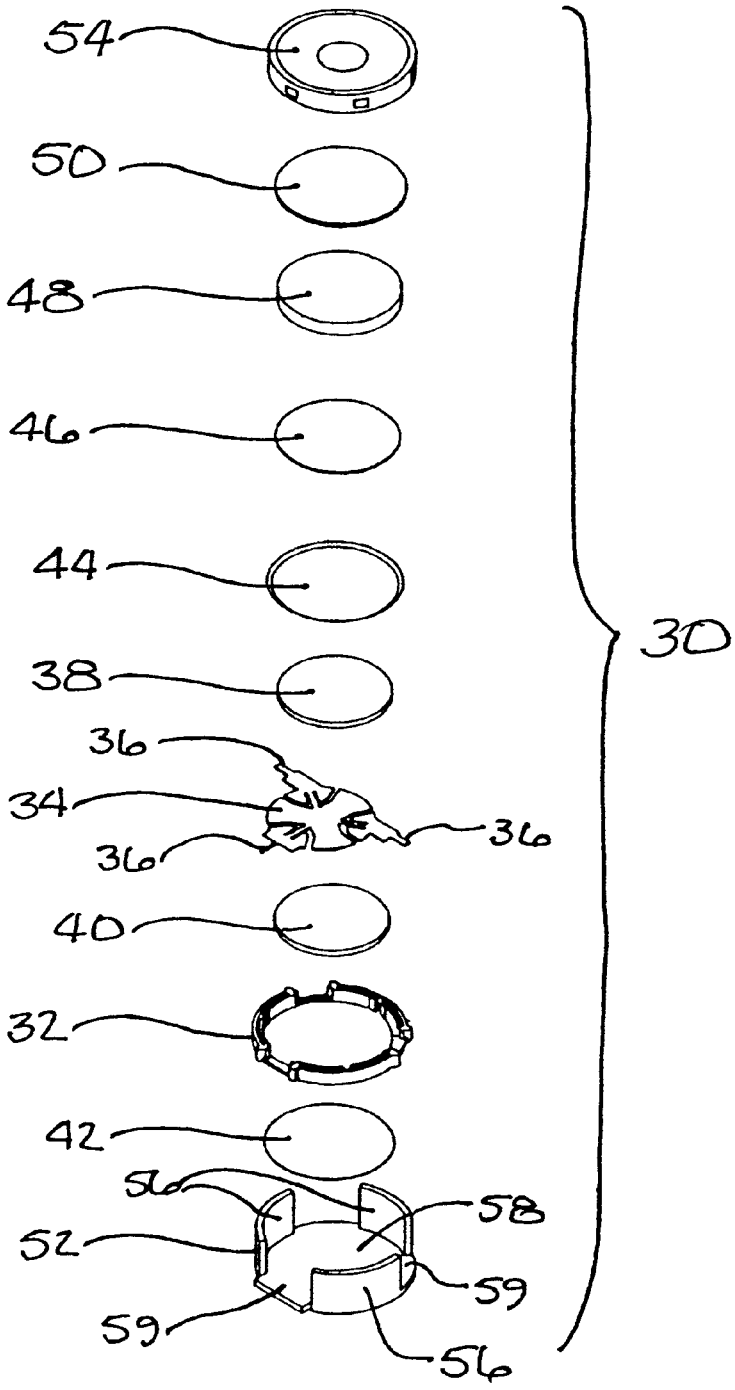
FIG. 6 is an exploded isometric view of a ferrite circulator according to the present invention.

A circulator 30 incorporating an alignment frame 32 according to the present invention is illustrated in FIG. 6. The circulator incorporates a center conductor or circuit 34 having three leads or ports 36. An upper ferrite disc 38 is disposed above the circuit and a lower ferrite disc 40 is disposed below the circuit. The ferrite discs and the circuit are freely contacting, with no adhesive therebetween. Other typical components of the circulator, such as a pole piece 42, ground plane 44, pole piece disc 46, magnet 48, and cover return 50 are also included in the assembly. The components are assembled and encased in a housing assembly. The housing assembly is typically formed in two pieces: a base housing 52 and a cover 54. The base housing includes upstanding walls 56 that define an interior region 58 in which the ferrite discs, the circuit, and the other components are located. The walls include cut away sections 59 through which the leads 36 of the circuit protrude.

Figure 7:
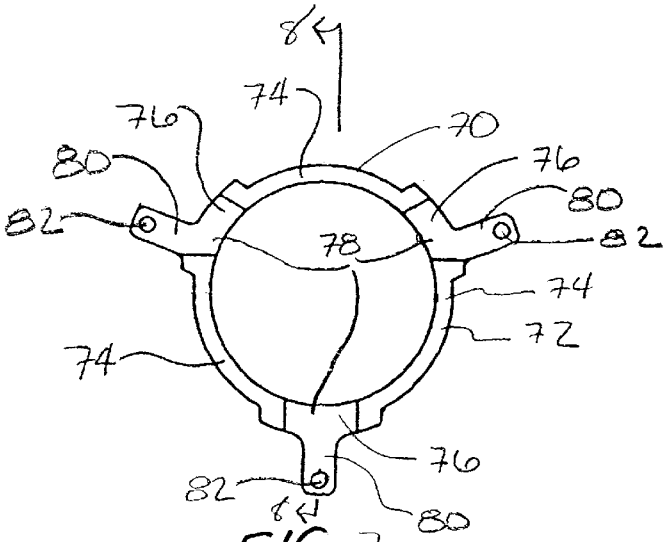
FIG. 7 is a plan view of an alignment frame according to the invention.
Figure 8:
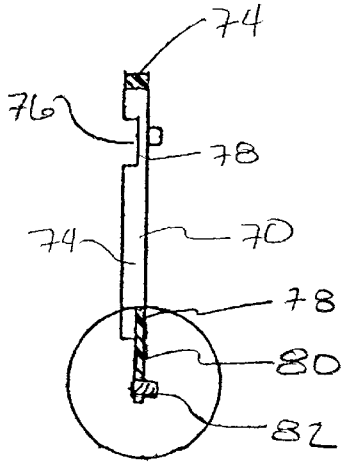
FIG. 8 is a cross-sectional view along line 8—8 of the alignment frame of FIG. 7.
Figure 9:
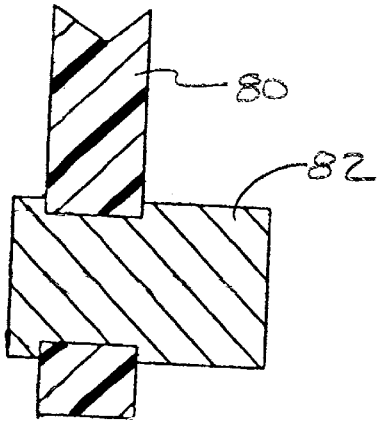
FIG. 9 is an enlarged cross-sectional view of the circled portion of FIG. 8.

A preferred embodiment of an alignment frame according to the invention is illustrated more particularly in FIGS. 7–9. The alignment frame comprises a nonconductive peripheral member 70 configured to fit within the interior region 58 of the base housing 52. In the embodiment illustrated, the peripheral member 70 is circular or ring-shaped, although the peripheral member may be provided in other shapes, such as square, rectangular or triangular, if desired, to accommodate the shape of the particular device. The peripheral member includes an exterior upstanding wall 72 divided into three exterior upstanding wall portions 74 separated by spaces 76 through which the leads 36 of the circuit 34 pass. The spaces are aligned with the cutaway sections 59 of the base housing 52 when the alignment frame is placed in the base housing. The upstanding wall portions 74 are preferably sized and configured to provide a slip fit with the interior of the walls 56 of the base housing. A tighter friction fit may be provided if desired. The wall portions 74 are also preferably sized and configured to provide a mechanical friction or interference fit with the ferrite discs. In this way, the discs and circuit are retained by the alignment frame in the housing with no adhesive.

The peripheral member 70 of the alignment frame 65 also includes bridging pieces 78 between each exterior upstanding wall portion 74 for supporting the circuit leads. Legs 80 extend radially outwardly from the bridging pieces 78 of the alignment frame. Each leg includes a conductive member 82 formed at or near the tip. The legs underlie and support the fragile circuit leads, and the conductive members provide a good electrical connection between a component below the legs (not shown) and the circuit leads. In this manner, the legs support the leads such that direct and indirect forces on the leads are transmitted to the alignment frame, which is retained in the housing. The alignment frame 65 is preferably configured to support the circuit sufficiently to withstand a pull test of 5 N on each leg. This test is typically performed during manufacturing.

Figure 10:
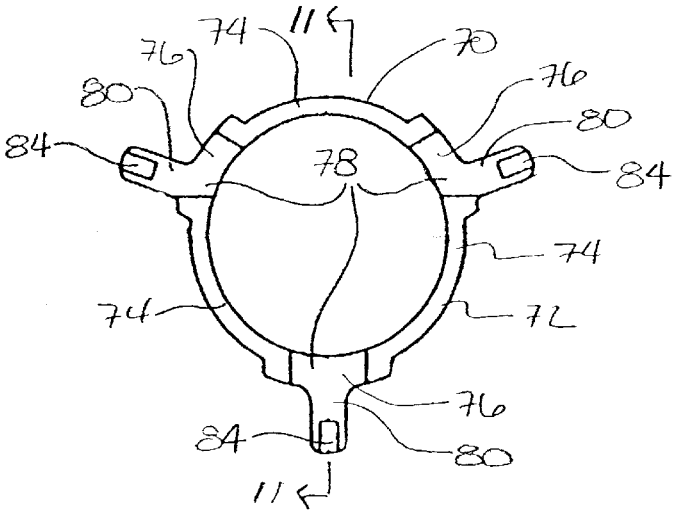
FIG. 10 is a plan view of a still further embodiment of an alignment frame of the present invention.
Figure 11:
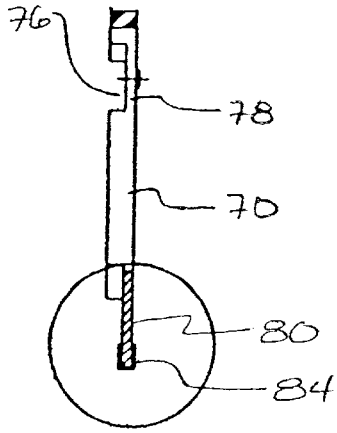
FIG. 11 is a cross sectional view along line 11—11 of the alignment frame of FIG. 10.
Figure 12:
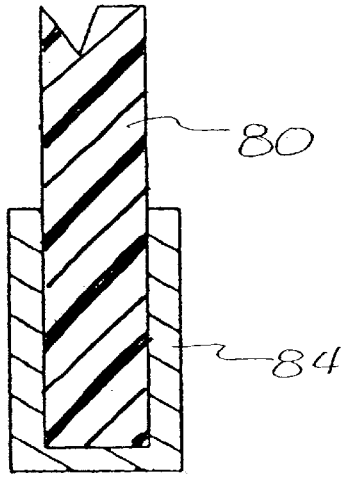
FIG. 12 is an enlarged cross-sectional view of the circled portion of FIG. 11.
Figure 13:
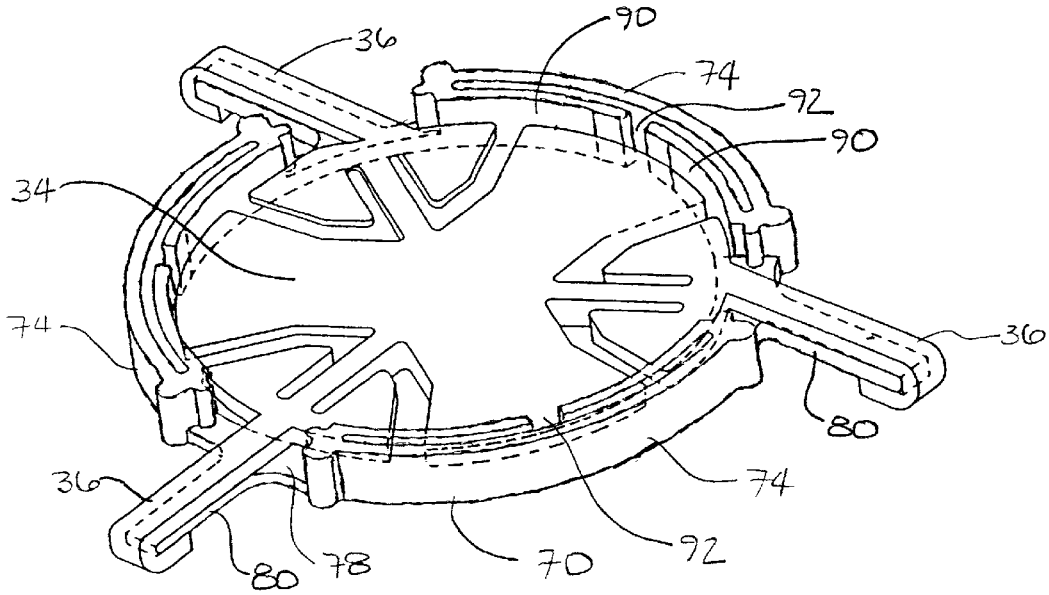
FIG. 13 is an isometric view of a further embodiment of an alignment frame of the present invention.

The conductive members may be in any suitable form. For example, in FIGS. 7–9, the conductive members are in the form of pins 82 that extend through openings in the legs 80. In another embodiment of the alignment frame illustrated in FIGS. 10–12, the conductive members are in the form of tabs 84 that wrap around the tips of the legs 80. The conductive members may be formed in any suitable manner, such as by insert molding or over molding with the frame. Alternatively, the conductive members may be formed as snap fit pieces that are attached to the alignment frame after the frame has been manufactured. In a further alternative, illustrated in FIG. 13, the conductive members may be omitted from the legs, and the circuit leads may themselves be wrapped around the tips of the legs. In these embodiments, like reference numerals have been used to designate like elements.

Figure 14:
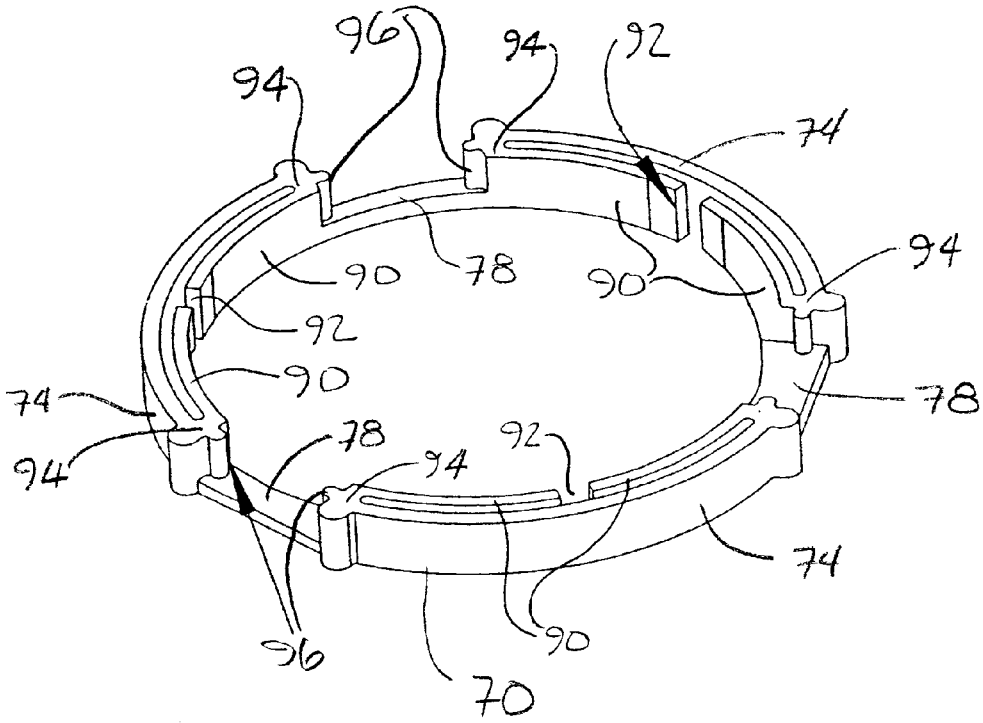
FIG. 14 is an isometric view of a still further embodiment of an alignment frame of the present invention.

A further embodiment of an alignment frame suitable for use with ferrite discs manufactured with larger tolerances is illustrated with more particularity in FIG. 14. The alignment frame includes three interior upstanding wall sections 90 in curved alignment with the three exterior upstanding wall portions 74. Each of the interior wall sections includes a split or space 92, generally at the midpoint of each section 90, that divides the section into two halves. The opposite ends of each interior wall section 90 are joined to opposed wall members 94 attached to the ends of each exterior wall portion 74. The split wall sections 90 are disposed such that the ferrite discs 38, 40 fit within the alignment frame with a mechanical friction or interference fit and are aligned by the frame. The sections are sufficiently flexible to allow them to accommodate ferrite discs having larger dimensional tolerances. The diameter of the ferrite discs may vary by 0.002 to 0.004 inch depending on the manufacturing process. Allowing the ferrite discs to be manufactured with larger tolerances reduces manufacturing costs. Although omitted from the embodiment illustrated in FIG. 14, the legs 80 that support the circuit leads may be provided if the additional support they provide for the circuit leads is desired, as illustrated, for example, in FIG. 13.

Figure 15:
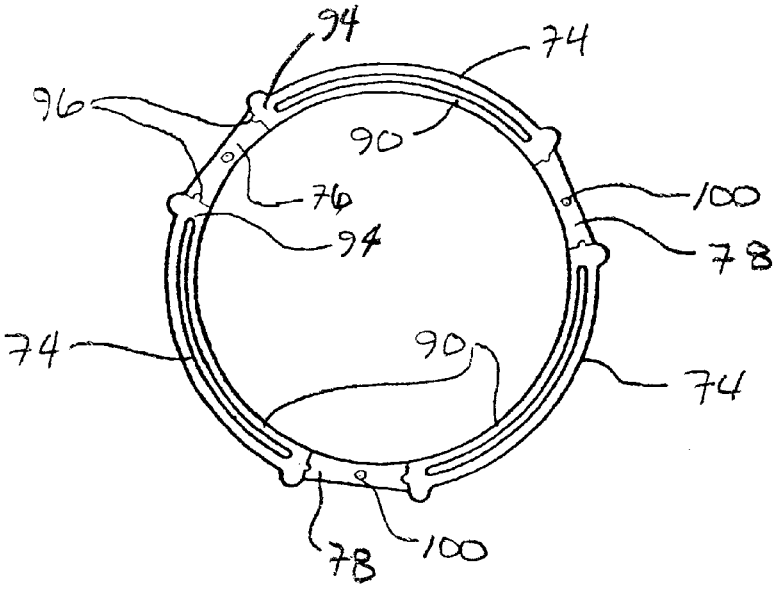
FIG. 15 is a plan view of a still further embodiment of an alignment frame of the present invention.
Figure 16:
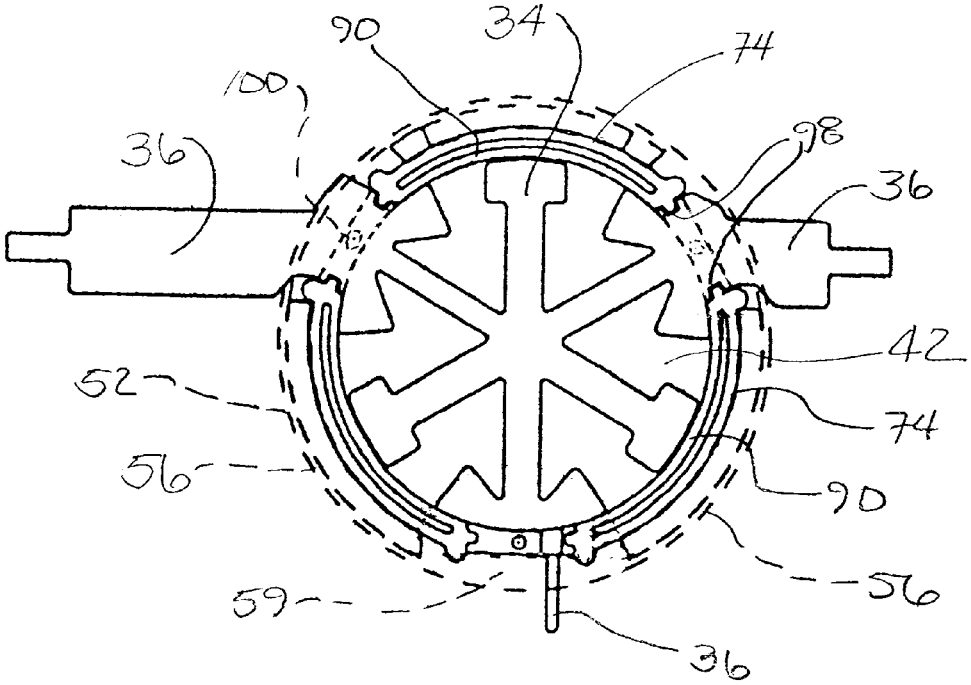
FIG. 16 is a plan view of the alignment frame of FIG. 15 in partial assembly with a circuit, ferrite disc, and base housing.

In another embodiment of an alignment frame 132, illustrated in FIGS. 15 and 16, the interior upstanding wall sections 90 are continuous between the opposed wall members 94, not split. The interior wall sections are also in curved alignment with the three exterior wall portions 74. The continuous interior wall sections provide some flexibility, although not as much as the split wall sections. However, depending on the tolerances with which the ferrite discs are manufactured, this amount of flexibility may be sufficient.

Referring to FIGS. 14–16, the end walls 94 of the upstanding wall portions 74 preferably include opposed projections 96 that extend circumferentially inwardly toward the spaces 76 to contact corresponding notches 98 in the leads 36. The projections may take any suitable configuration, such as the rounded ribs shown. The bridging pieces 78 may also include upstanding projections 100, preferably point projections, in the center, illustrated in FIGS. 15–16. These projections space the circuit 34 away from the material of the alignment frame, thereby increasing the air space around the circuit, to minimize any effect from dielectric differences between the circuit and the frame. It will be appreciated that the projections 96 and/or the projections 100 may be provided with other embodiments, such as those of FIGS. 7–12, if desired.

Figure 17:
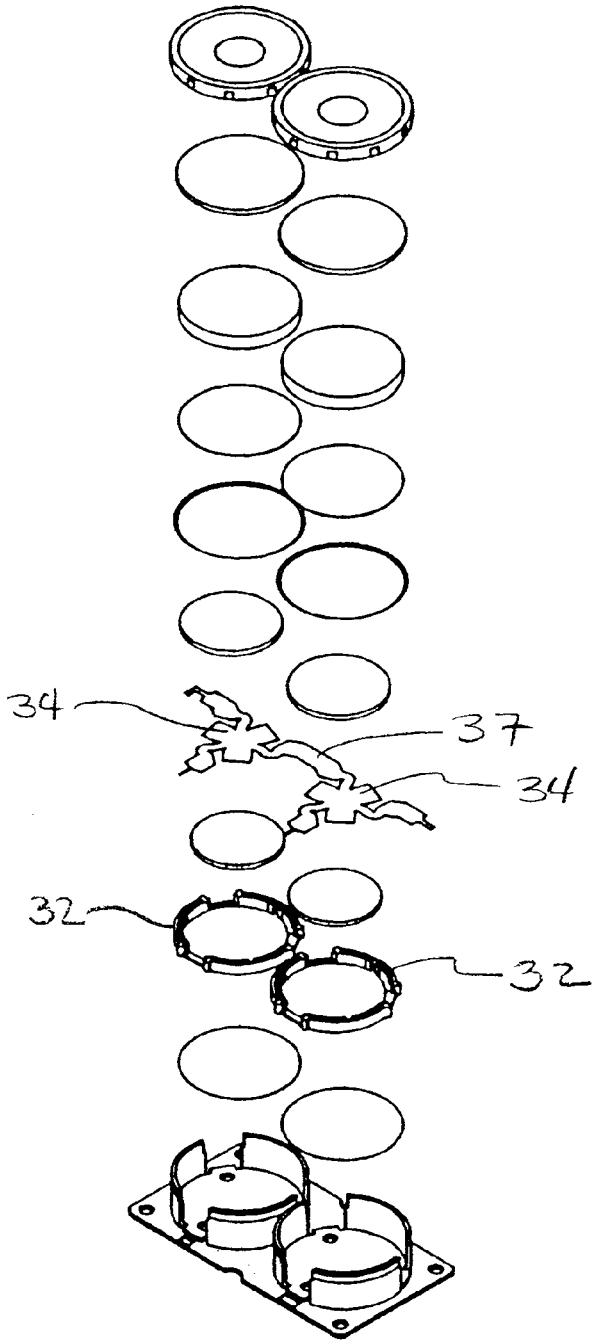
FIG. 17 is an exploded isometric view of multiple alignment frames used in a multiple junction application.

FIG. 17 illustrates an example of multiple alignment frames 32 of the present invention used in a multiple junction application. In this application, two or more circuits 36 are joined at attached link 37. Any number of junctions can be provided, depending on the application.

The peripheral member 70 of the alignment frame may be made from any suitable nonconductive material. Preferably a material that can withstand solder reflow temperatures (typically greater than 230° C.) is used, because the device is typically passed through a solder reflow oven during manufacture. Liquid crystal polymers or high temperature plastics, which may be strengthened with glass reinforcing fibers or particles, are suitable. If the alignment frame is not intended for exposure to high temperature environments, other materials, such as polyesters, polypropylenes, or paper/epoxy materials, may be used. The alignment frame may be made by any suitable process. For example, an injection molding process that provides a one-piece assembly is suitable. Alternatively, a machining process may be more suitable depending on the choice of materials. The alignment frame preferably has a neutral rotational orientation.

The invention is not to be limited by what has been particularly shown and described, except as indicated by the appended claims.

What is claimed is:

1. An alignment frame for a passive ferrite isolator or circulator comprising a circuit having a plurality of leads, an upper ferrite disc above the circuit, and a lower ferrite disc below the circuit, the circuit, the upper ferrite disc, and the lower ferrite disc disposed in an interior region of a housing assembly having openings therein for the leads, the alignment frame comprising:

a non-conductive peripheral member, the non-conductive peripheral member including:

a plurality of upstanding wall portions separated by spaces disposed to receive the leads of the circuit, and legs extending radially outwardly from the region of the spaces to support the plurality of leads of the circuit.

2. The alignment frame of claim 1, further comprising a conductive member disposed proximate a tip of each leg for electrical connection with an associated circuit lead.

3. The alignment frame of claim 2, wherein the conductive member comprises a pin supported within an opening in the leg.

4. The alignment frame of claim 2, wherein the conductive member comprises a tab member wrapped over the tip of the leg.

5. The alignment frame of claim 1, wherein the non-conductive peripheral member further includes bridging pieces joining the plurality of upstanding wall portions and extending across the spaces to support associated ones of the leads of the circuit, the legs extending radially outwardly from the bridging pieces.

6. The alignment frame of claim 5, wherein the bridging pieces include projections for spacing the circuit leads from the alignment frame.

7. The alignment frame of claim 1, wherein the non-conductive peripheral member is configured to support the circuit sufficiently so that the circuit leads withstand a pull test force of 5 N.

8. The alignment frame of claim 1, further comprising projections at ends of the upstanding wall portions disposed to mate with corresponding notches in the leads.

9. The alignment frame of claim 8, wherein the projections comprise rounded ribs.

10. The alignment frame of claim 1, further comprising interior upstanding flexible wall portions in spaced alignment with and radially interiorly of the upstanding wall portions.

11. The alignment frame of claim 10, wherein the interior wall portions are sized to provide a mechanical friction fit with the upper ferrite disc and the lower ferrite disc.

12. The alignment frame of claim 10, wherein the interior upstanding wall portions are split at a midpoint.

13. The alignment frame of claim 12, wherein the interior wall portions are sized to provide a mechanical friction fit with the upper ferrite disc and the lower ferrite disc.

14. The alignment frame of claim 10, wherein the interior upstanding wall portions are joined to the upstanding wall portions at end wall portions.

15. A passive ferrite isolator or circulator device comprising:

the alignment frame of claim 1;

a circuit having a plurality of leads;

an upper ferrite disc above the circuit;

a lower ferrite disc below the circuit; and a housing assembly having an interior region and a plurality of openings therein, the circuit, the upper ferrite disc, and the lower ferrite disc disposed in the alignment frame in the interior region of a housing assembly with the leads disposed through the openings.

16. The device of claim 15, wherein the upper ferrite disc and the circuit are freely contacting, and the lower ferrite disc and the circuit are freely contacting.

17. An alignment frame for a passive ferrite isolator or circulator comprising a circuit having a plurality of leads, an upper ferrite disc above the circuit, and a lower ferrite disc below the circuit, the circuit, the upper ferrite disc, and the lower ferrite disc disposed in an interior region of a housing assembly having openings therein for the leads, the alignment frame comprising:

a non-conductive peripheral member, the non-conductive peripheral member including:

a plurality of upstanding exterior wall portions separated by spaces disposed to receive the leads of the circuit, and a plurality of interior upstanding flexible wall portions in spaced alignment with and radially interiorly of the upstanding wall portions, the interior wall portions sized to provide a mechanical friction fit with the upper ferrite disc and the lower ferrite disc.

18. The alignment frame of claim 17, wherein the interior upstanding wall portions are split at a midpoint.

19. The alignment frame of claim 17, wherein the interior upstanding wall portions are joined to the upstanding wall portions at end wall portions.

* * * * *